US010638799B2

(12) United States Patent
Karon et al.

(10) Patent No.: US 10,638,799 B2
(45) Date of Patent: May 5, 2020

(54) STRAPLESS AND BACKLESS BRASSIERE

(71) Applicant: COCONUT GROVE PADS, INC., Markham (CA)

(72) Inventors: Hylton Karon, Markham (CA); Tanya Wiebe, Toronto (CA)

( * ) Notice: Subject to any disclaimer, the term of this patent is extended or adjusted under 35 U.S.C. 154(b) by 274 days.

(21) Appl. No.: 15/860,693

(22) Filed: Jan. 3, 2018

(65) Prior Publication Data

US 2019/0200681 A1 Jul. 4, 2019

(51) Int. Cl.
*A41C 3/06* (2006.01)

(52) U.S. Cl.
CPC ..... *A41C 3/065* (2013.01)

(58) Field of Classification Search
CPC ..... A41C 3/065
USPC ..... 450/81, 37
See application file for complete search history.

(56) References Cited

U.S. PATENT DOCUMENTS 2,685,086 A * 8/1954 Henry ..... A41D 27/133 2/55
2,869,553 A * 1/1959 D'Or ..... A41C 3/065 450/81
6,857,935 B1 * 2/2005 Dohan ..... A41C 3/065 2/244
7,229,335 B2 * 6/2007 Davis ..... A41C 3/065 450/54
D594,650 S * 6/2009 Doty ..... D3/222
7,905,763 B1 * 3/2011 Frank ..... A41D 31/12 450/37
8,038,660 B2 * 10/2011 Bruce ..... A61F 13/141 128/890
2001/0049250 A1 * 12/2001 Johnson ..... A41C 3/065 450/81
2005/0221719 A1 * 10/2005 Chou ..... A41C 3/065 450/81
2005/0282468 A1 * 12/2005 Davis ..... A41C 3/065 450/81
2006/0089085 A1 * 4/2006 Ruggiero ..... A41C 3/06 450/81
2007/0218805 A1 * 9/2007 Mateo ..... A41C 3/065 450/81
2009/0149114 A1 * 6/2009 Horton ..... A41C 3/065 450/54

* cited by examiner

*Primary Examiner* — Gloria M Hale

(57) ABSTRACT

The present invention discloses a strapless, backless adhesive shaping breast lift that is suitable for lifting and holding larger breasts in position. Further, the design of the strapless, backless adhesive shaping breast lift comprises two breast support structures, wherein each of the breast support structures comprises a plurality of tabs at the upper portion and a plurality of scallops at the bottom portion of the brassiere, so as to maintain a round breast shape, even on a larger cup size. The adhesive material allows a user to pull the plurality of the tabs and scallops to adjust the shape of the brassiere while distributing the weight of the breast on the tabs and scallops. Further, circular cuts between the tabs help to maintain a round shape of the breast by minimizing the size and number of creases on the brassiere.

13 Claims, 5 Drawing Sheets

STRAPLESS AND BACKLESS BRASSIERE

FIELD OF THE INVENTION

This invention relates to a strapless and backless brassiere and, more particularly, to a strapless and backless brassiere that lifts the breast, provides round shape to the brassiere, and minimizes the depth and number of creases on the brassiere when worn by a user.

BACKGROUND OF THE INVENTION

Women in modern society are conditioned to wear a brassiere. The brassiere provides support, to lift, to flatter, to enhance and to shape. A woman's breast is a sign of femininity and a brassiere serves to not only accentuate that femininity, but also to protect and support it.

The brassiere has undergone an evolution from corset to bralettes to wired brassiere cups to backless, strapless brassieres. As brassiere designers have access to more modern manufacturing processes and fabrics, the brassieres available on the market today can serve women in a multitude of ways that were impossible before. For example, women wearing a backless dress or a halter-top will not want to wear a traditional brassiere. As a result, brassieres have been developed that are both backless and strapless. Backless, strapless bras are particularly gaining momentum as women seek a cleaner look to their outfits by not having brassiere straps on display. Such backless, strapless brassieres have used non-permanent adhesives, such as a disposable double-sided tape, to secure the brassiere to the user. The common adhesive used in backless, strapless bras is polyolefin gel and silicone adhesive, but these types of adhesives when used with conventional backless and strapless brassiere designs are insufficient to support the weight of a breast larger than a small D cup. Furthermore, known backless, strapless brassieres have relied on tabs that extend from the outer surface of the brassiere cups to secure the brassiere cups to the user's skin, and have provided very limited means for enhancing breast cleavage and breast push-up. Moreover, most of the conventional backless and strapless brassieres have an arc-shaped peripheral region that cannot be attached to different sections of the rim of a breast for best coverage without any crease or fold. Further, most of the conventional backless, strapless brassieres have two cup-shaped breast-boosting sections that are connected to each other. Further, some of the backless and strapless brassieres comprise two single cups or breast support structures to cover each of the breasts independently, but are not suitably designed to provide rounded shape to the breasts without any crease or fold.

It is apparent now that numerous innovations for a backless, strapless brassiere have been developed in the prior art that are adequate for various purposes. Furthermore, even though these innovations may be suitable for the specific purposes that they address, they would not be suitable for the purposes of the present invention as described here. Thus to overcome the shortcomings, the present invention intends to provide a backless, strapless brassiere to mitigate the aforementioned problems.

SUMMARY OF THE INVENTION

The present invention discloses a strapless, backless brassiere that is suitable for lifting and holding breasts in position. Further, the design of the strapless, backless brassiere comprises two breast support structures, wherein each of the breast support structures comprises a plurality of tabs at the upper portion and a plurality of scallops at the bottom portion of the brassiere, so as to maintain a round breast shape, even on a larger cup size. The adhesive material allows the user to pull the tabs and scallops to adjust the shape of the brassiere while distributing the weight of the breast on the tabs and scallops. Further, circular cuts between the tabs allow the bra to maintain a round shape of the breast by minimizing the size and number of bra creases.

According to an aspect of the present invention, a strapless and backless brassiere, which comprises two breast support structures, wherein the breast support structures are made of stretchable medical adhesive tap; such as 3M brand Medical Tape 9907T, and are configured to be arranged to at least partially cover the breasts and create a round shape of the breasts of a user, wherein each of the breast support structures comprises an upper half portion and a lower half portion, whereby the upper half portion comprises at least a first tab, a second tab and a third tab, further a first cut joining the first tab with the second tab and a second cut joining the third tab with the second tab, further the lower half portion of the breast support structures comprises a plurality of scallops.

In view of the foregoing, it is therefore an object of the present invention to provide a strapless and backless brassiere that is designed to support larger breasts from United States sizes 36-38B up to and including 30-32I (United Kingdom sizes 36-38B up to and including 30-32G) cup size in position.

Another objective is to provide a strapless and backless brassiere that comprises a plurality of tabs at the upper portion.

Another objective is to provide a strapless and backless brassiere that comprises a plurality of scallops at the lower portion.

Yet another objective is to provide a strapless and backless brassiere that comprises an adhesive material that allows each tab to distribute the weight of the breast over a larger surface area.

Yet another objective is to provide circular cuts at the bottom of the tabs to eliminate the points that are formed when the tabs are brought together towards each other.

Yet another objective is to provide a strapless and backless brassiere that comprises a plurality of scallops to reduce the number and depth of creases formed on the brassiere.

Yet another objective is to provide a strapless and backless brassiere comprising a plurality of tabs at the upper half portion of the brassiere, thereby creating a round shape of the breasts.

Other objectives and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1A:
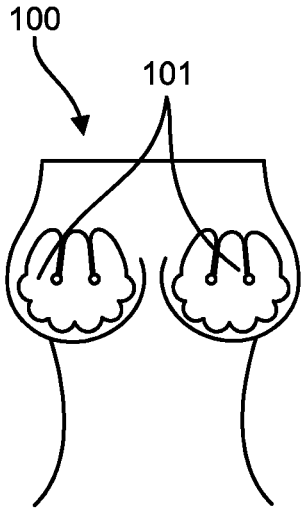
FIG. 1A illustrates a front view of a strapless and backless brassiere, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "side," "front," "perspective," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

The present invention discloses a strapless, backless brassiere 100 that is referenced in FIGS. 1A, 1B, 4, 5A, 6A and 7. The design of the strapless, backless brassiere 100 comprising two breast support structures 101 which are two-dimensional stickers, wherein each of the breast support structures 101 comprise at least three tabs 102*a-c* at the upper portion 108 and at least three scallops 104*a-f* at the bottom portion 110 of the brassiere 100, so as to maintain a round shape of the breasts of a user, even on a larger cup size. The adhesive material allows a user to pull the tabs 102*a-c* and the scallops 104*a-f* to adjust the shape of the brassiere 100 while distributing the weight of the breast on the tabs 102*a-c* and scallops 104*a-f*. Further circular cuts 106*a-b* between the tabs 102*a-c* eliminate formation of pointed structures 112 when the tabs 102*a-c* are brought together towards each other. Additionally, the scallops 104*a-f* at the lower portion 110 of the brassiere 100 allow the reduction of the number and depth of creases 114 formed on the brassiere 100. The tabs at both sides 102*a*, 102*c* pull the sides of the breast inward to create a round shape of the breast while distributing the weight of the breast to be shared by three attach points 102*a-c* of each tab 102*a-c* over a larger surface area. The at least three tabs 102*a-c* transform the two-dimensional sticker into a three-dimensional shape on the body in order to support larger breasts from United States sizes 36-38B up to and including 30-32I (United Kingdom sizes 36-38B up to and including 30-32G) cup size in a round shape, substantially in accordance with the size chart below:

| US Size Chart | | UK Size Chart | |
|---|---|---|---|
| SIZE 1 FITS: | SIZE 2 FITS: | SIZE 1 FITS: | SIZE 2 FITS: |
| B 36-38 | B 42-46 | B 36-38 | B 42-46 |
| C 34-36 | C 40-44 | C 34-36 | C 40-44 |
| D 32-34 | D 38-42 | D 32-34 | D 38-42 |
| DD 30-32 | DD 36-40 | DD 30-32 | DD 36-40 |
| | DDD 34-38 | | E 34-38 |
| | G 32-36 | | F 32-36 |
| | H 30-34 | | FF 30-34 |
| | I 30-32 | | G 30-32 |

and in a desired position.

According to one aspect of the present invention a strapless and backless brassiere 100, two independent breast support structures (also referred to as stickers) 101 allow a user to wear one on each of her breasts. The breast support structures 101 are made of stretchable medical adhesive tape and are configured to be arranged to at least partially cover the breasts and create a round shape of the breasts of a user. Each of the breast support structures 101 comprises an upper half portion 108 and a lower half portion 110. The upper half portion 108 comprises at least a first tab 102*a*, a second tab 102*b* and a third tab 102*c*. A first cut 106*a* joins the first tab 102*a* with the second tab 102*b* and a second cut 106*b* joins the third tab 102*c* with the second tab 102*b*. The lower half portion 110 of the breast support structures 101 comprises a plurality of scallops 104*a-f*.

In another aspect, a method 200 of supporting breasts, the method 200 comprises a step 202 of holding a first breast support structure 101 made of stretchable tape having one side coated with adhesive, wherein each of the breast support structures 101 comprises an upper half portion 108 and a lower half portion 110, whereby the upper half portion 108 comprises at least a first tab 102*a*, a second tab 102*b* and a third tab 102*c*, further a first cut 106*a* joining the first tab 102*a* with the second tab 102*b* and a second cut 106*b* joining the third tab 102*c* with the second tab 102*b*, further the lower half portion 110 of each of the breast support structures 101 comprises a plurality of scallops 104*a-f*; a step 204 of adhering the lower half portion 110 of the breast support structure 101 to the lower part of the first breast; a step 206 of lifting up the second tab 102*b* of the upper half portion 108 of the breast support structure 101 over the first breast and adhering the second tab 102*b* to the upper central portion of the first breast to lift the breast up; a step 208 of lifting up the first tab 102*a* of the upper half portion 108 of the breast support structure 101 over the first breast and adhering the first tab 102*a* to the upper left portion of the first breast; a step 210 of lifting up the third tab 102*c* of the upper half portion 108 of the breast support structure 101 over the first breast and adhering the third tab 102*c* to the upper right portion of the first breast; and a step 212 of repeating the above steps 202-210 for supporting the second breast by a symmetrical second breast support structure 101, wherein the first cut 106*a*, the second cut 106*b* and the plurality of scallops 104*a-f* help to maintain a round shape of the brassiere 100 over the breasts while reducing the number and depth of brassiere creases 114 and pointed structures 112 formed around the breasts of the user, while the first tab 102*a*, the second tab 102*b* and the third tab 102*c* allow for the weight of each of the breasts to be shared by the tabs 102*a-c* adhered to the breast at different points, distributing the weight over a larger surface area.

In another aspect, the stretchable medical adhesive tape of the brassiere can lift and support weight up from United States sizes 36-38B up to and including 30-32I (United Kingdom sizes 36-38B up to and including 30-32G) cup size breast.

In another aspect, the lower half portion 110 of the breast support structures 101 comprises at least three scallops 104*a-f*, although any number of scallops can be used without departing from the scope and spirit of the present invention.

In another aspect, the first cut 106*a* and the second cut 106*b* are circular in shape, although any shape of the cuts meant to solve the desired purpose can be used without departing from the scope and spirit of the present invention.

In another aspect, the first tab 102*a* and the third tab 102*c* pull the sides of the breast inward to create a round shape of the breasts.

In another aspect, the first tab 102*a*, the second tab 102*b* and the third tab 102*c* allow for the weight of the breast to be shared by the tabs 102*a-c* adhered to the breast at different points, distributing the weight of the breast over a larger surface area.

In another aspect, the brassiere 100 of the present invention comprises two two-dimensional stickers 101 comprising at least three tabs 102*a-c* at the upper portion 108 and at least three scallops 104*a-f* at the bottom portion 110, so that each of the two-dimensional stickers 101 transforms into a three-dimensional shape on the breast of the user, so as to maintain a round breast shape, even on a larger cup size.

In another aspect, it is safe to wear the brassiere 100 of the present invention for 8 hours on all cup sizes including sizes larger than a D cup, while other brands and products strongly warn against use for sizes larger than a D cup.

Figure 1B:
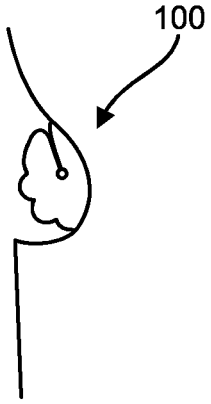
FIG. 1B illustrates a side view of a strapless and backless brassiere, in accordance with an embodiment of the present invention.

An embodiment of the brassiere 100 of the present invention is referenced in FIG. 1A showing a front view of the brassiere 100. The brassiere 100 comprises two breast support structures 101, wherein each of the breast support structures 101 comprises a plurality of tabs 102*a-c*, scallops 104*a-f* and cuts 106*a-b*. These pluralities of tabs 102*a-c*, cuts 106*a-b* between the tabs 102*a-c*, and scallops 104*a-f* allow the brassiere 100 to create a round shape of the breasts as shown in FIG. 1B.

Figure 2A:
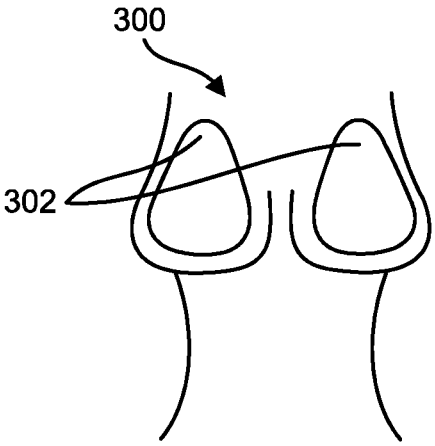
FIG. 2A illustrates a front view of a first conventional strapless and backless brassiere known in the prior art.
Figure 2B:
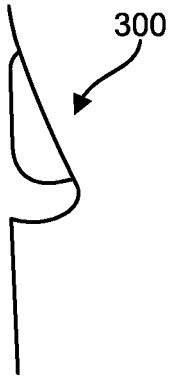
FIG. 2B illustrates a side view of the first conventional strapless and backless brassiere known in the prior art.
Figure 3A:
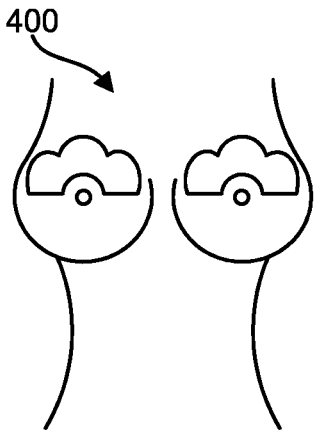
FIG. 3A illustrates a front view of a second conventional strapless and backless brassiere known in the prior art.
Figure 3B:
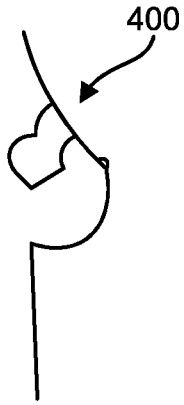
FIG. 3B illustrates a side view of the second conventional strapless and backless brassiere known in the prior art.

However, examples of two types of conventional, prior art breast lift products 300 and 400 are shown in the FIGS. 2A-3B that lift the breasts from above the nipple, causing the breast shape to become pointed at the nipple area. In contrast, the brassiere 100 of the present invention lifts the breasts from under the breast to ensure that the breast shape remains round in appearance on larger cup sizes. A front view of the first conventional brassiere shown in FIG. 2A is a teardrop shaped adhesive lift brassiere 300 and its side view is shown in FIG. 2B illustrating only one tab 302 that takes the weight of the breast at a single point. Further it does not have slashes or cuts to create a "dart" effect on the body, thereby causing a large breast to become flattened, which is deemed to be an unflattering shape. The front view of the second conventional adhesive lift brassiere 400 shown in FIG. 3A and its side view shown in FIG. 3B illustrate the brassiere 400 supporting only the upper portion of the breasts, to lift the breasts thereby creating a pointed appearance of the breasts. These conventional designs, 300 and 400, lack a plurality of tabs, cuts between the tabs and scallops, and are thus unable to support larger breasts and also insufficient to provide a round shape to the breasts without bra creases.

Figure 4:
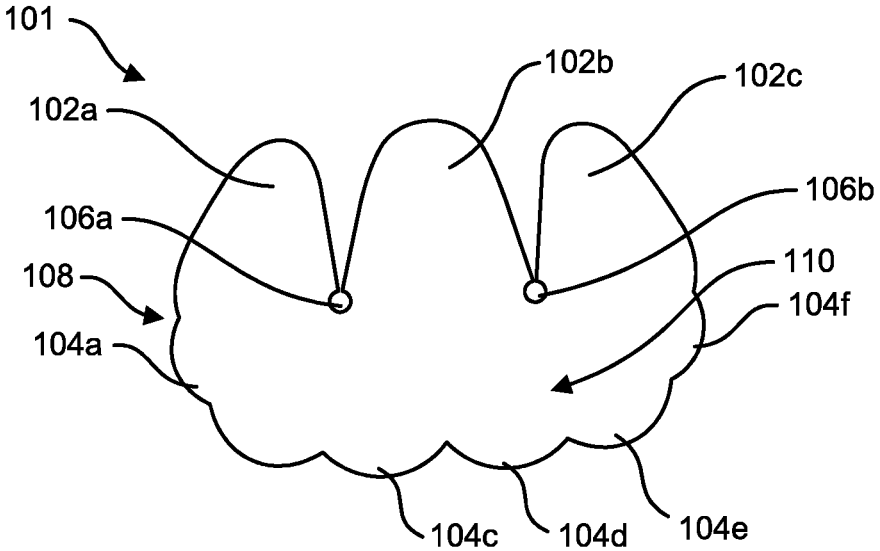
FIG. 4 illustrates a front view of a breast support structure of the strapless and backless brassiere, in accordance with an embodiment of the present invention.

An exemplary embodiment of the brassiere 100 of the present invention is referenced in FIG. 4 showing a front view of the breast support structures 101 of the brassiere 100. The breast support structure 101 is a two-dimensional adhesive sticker made of stretchable tape comprising an upper half portion 108 and a lower half portion 110, whereby the upper half portion 108 comprises at least a first tab 102*a*, a second tab 102*b* and a third tab 102*c*, further a first cut 106*a* joining the first tab 102*a* with the second tab 102*b* and a second cut 106*b* joining the third tab 102*c* with the second tab 102*b*, further the lower half portion 110 of the breast support structures 100 comprises a plurality of scallops 104*a-f*.

Figure 5A:
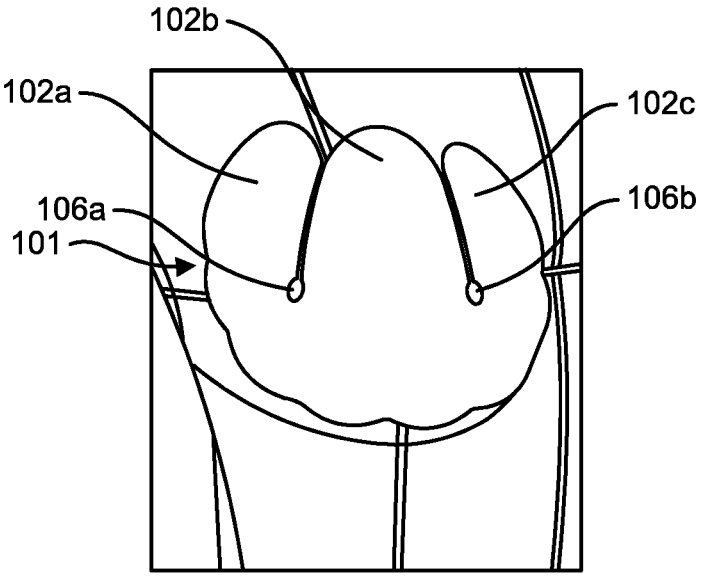
FIG. 5A illustrates a front perspective view of the strapless and backless brassiere comprising cuts between a plurality of tabs of the breast support structure, in accordance with an embodiment of the present invention.
Figure 5B:
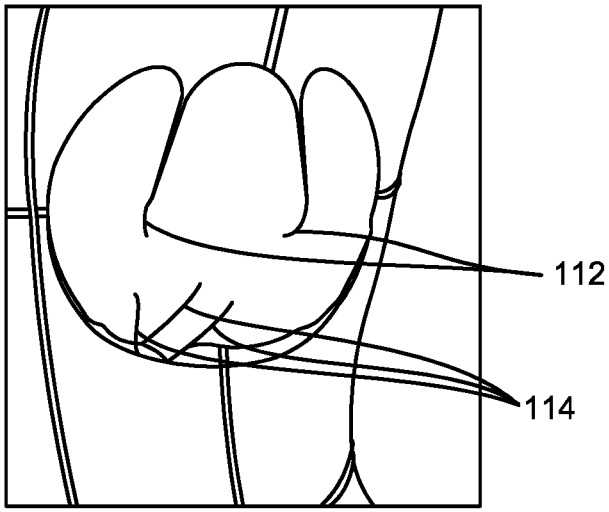
FIG. 5B illustrates a front perspective view of an exemplary strapless and backless brassiere having no circular cuts between the plurality of tabs.

Another exemplary embodiment of the brassiere 100 of the present invention as referenced in FIG. 5A showing the breast support structure 101 which is a two-dimensional sticker (FIG. 4) that transforms into a three-dimensional shape when worn on the breast of a user. The first and the second cuts 106*a-b* between the tabs 102*a-c* eliminate formation of pointed structures 112 when the tabs 102*a-c* are brought together towards each other. FIG. 5B shows the formation of pointed structures 112 or creases 114 when no cuts 106*a-b* are provided between the tabs 102*a-c* while the tabs 102*a-c* are brought together towards each other. Further the cuts 106*a-b* allow each of the tabs to act as an independent structure that distributes the weight of the breast across the attach points of each tab 102*a-c*, thus allowing the support of larger breasts from United States sizes 36-38B up to and including 30-32I (United Kingdom sizes 36-38B up to and including 30-32G) cup size. Further, the first tab 102*a* and the third tab 102*c* at the periphery allow a user to pull the sides of the breast inward to create a round shape of the breast.

Figure 6A:
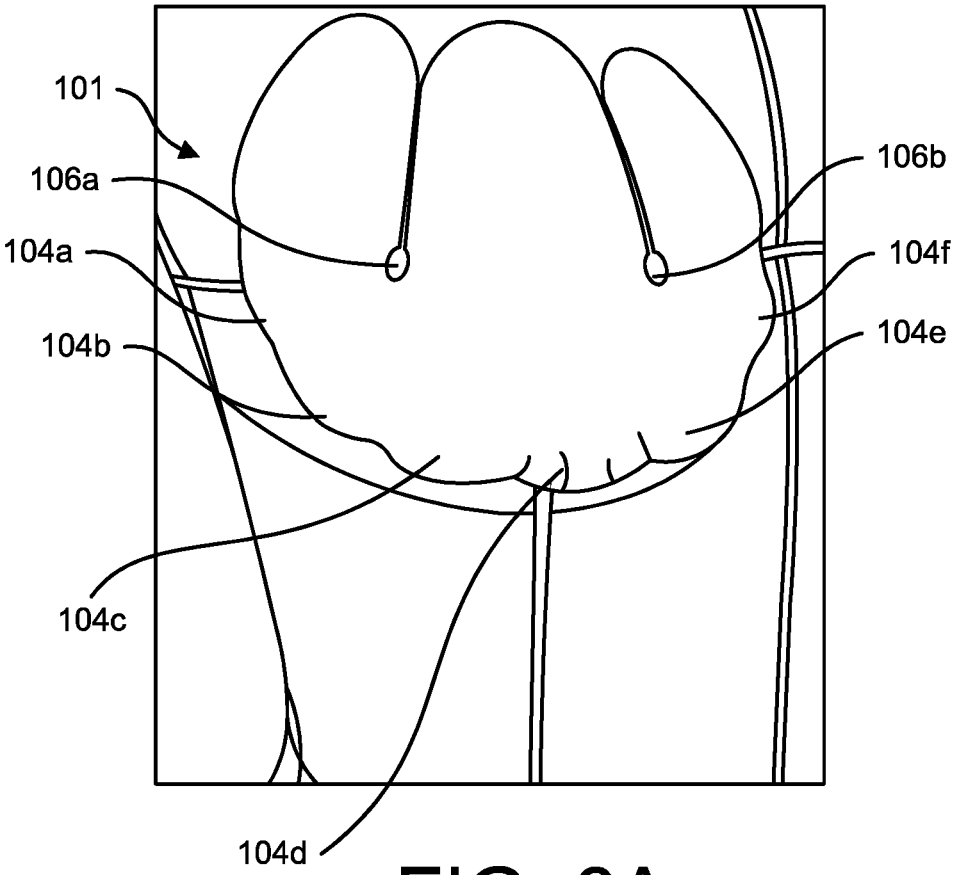
FIG. 6A illustrates a front perspective view of the strapless and backless brassiere comprising a plurality of scallops, in accordance with an embodiment of the present invention.
Figure 6B:
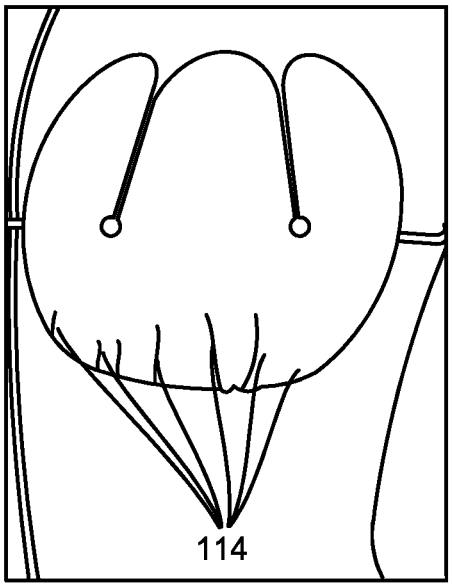
FIG. 6B illustrates a front perspective view of an exemplary strapless and backless brassiere having no scallops.

Another exemplary embodiment of the brassiere 100 of the present invention as referenced in FIG. 6A shows the plurality of scallops 104*a-f* at the lower portion 110 of the brassiere 100 that allow the reduction of the number and depth of creases 114 formed on the brassiere 100. FIG. 6B shows the formation of creases 114 as it does not have one or more scallops at the lower portion of the brassiere 100.

Figure 7:
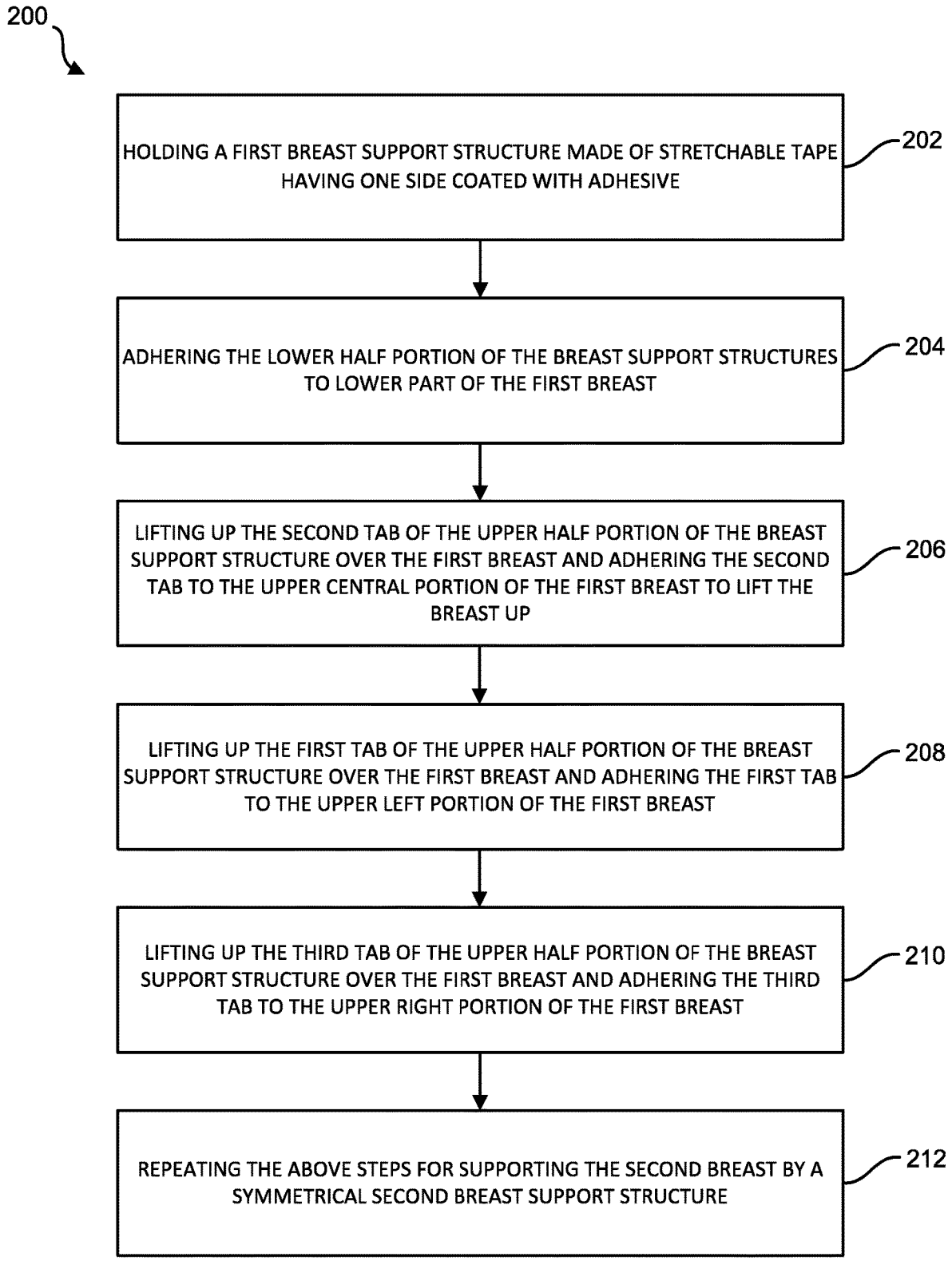
FIG. 7 illustrates a flow chart of a method of wearing the strapless and backless brassiere, in accordance with an embodiment of the present invention.

Another exemplary embodiment of the brassiere 100 of the present invention as referenced in FIG. 7 shows a flow chart illustrating a method 200 of wearing an adhesive shaping breast lift comprising the step 202 of holding a first breast support structure made of stretchable tape having one side coated with adhesive, wherein the breast support structure comprises an upper half portion and a lower half portion, whereby the upper half portion comprises at least a first tab, a second tab and a third tab, further a first cut joining the first tab with the second tab and a second cut joining the third tab with the second tab, further the lower half portion of the breast support structure comprises a plurality of scallops; the step 204 of adhering the lower half portion of the breast support structure to the lower part of the first breast; the step 206 of lifting up the second tab of the upper half portion of the breast support structure over the first breast and adhering the second tab to the upper central portion of the first breast to lift the breast up; the step 208 of lifting up the first tab of the upper half portion of the breast support structure over the first breast and adhering the first tab to the corresponding upper side portion of the first breast; the step 210 of lifting up the third tab of the upper half portion of the breast support structure over the first breast and adhering the third tab to the corresponding upper side portion of the first breast; and the step 212 of repeating the above steps for supporting the second breast by a symmetrical second breast support structure, wherein the first cut, the second cut and the plurality of scallops help maintain a round shape of the brassiere while reducing the number and depth of bra creases formed around the breasts of the user, while the first tab, the second tab and the third tab allows for the weight of the breast to be shared by the tabs adhered to the breast at different points, distributing the weight over a larger surface area.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A strapless and backless lift support brassiere for the breasts of a user, comprising:

two breast support structures, wherein the breast support structures are made of stretchable medical adhesive tape and are configured to be arranged to at least partially cover the said breasts and which are partially attached to an upper portion of said breasts, wherein each of the breast support structures comprises, an upper half portion and a lower half portion, whereby the upper half portion comprises at least a first tab, a second tab and a third tab, a first cut joining the first tab with the second tab and a second cut joining the third tab with the second tab, and the lower half portion of the breast support structure comprises a plurality of scallops.

2. The brassiere according to claim 1, wherein the stretchable medical adhesive tape of the brassiere can support weight from United States sizes 36-38B up to and including 30-32I cup size breast.

3. The brassiere according to claim 1, wherein the stretchable medical adhesive tape of the brassiere can support weight from United Kingdom sizes 36-38B up to and including 30-32G cup size breast.

4. The brassiere according to claim 1, wherein the lower half portion of the breast support structures comprises at least three scallops.

5. The brassiere according to claim 1, wherein the breasts have sides, and the first tab and the third tab pull the sides of the said breasts inward to create a round shape of the breasts.

6. The brassiere according to claim 1, wherein the first cut and the second cut are circular in shape.

7. The brassiere according to claim 1, wherein the breasts have a weight, and the first tab, the second tab and the third tab allows for the weight of the said breasts to be shared by the tabs adhered to the breasts at different points, distributing the weight of the breasts over a larger surface area.

8. A method of supporting two breasts having upper, lower and side parts, wherein the method comprises the steps of:

holding a first breast support structure made of stretchable tape having one side coated with adhesive, wherein the breast support structure comprises an upper half portion and a lower half portion, whereby the upper half portion comprises at least a first tab, a second tab and a third tab, and whereby a first cut joins the first tab with the second tab and a second cut joins the third tab with the second tab, and whereby the lower half portion of the breast support structure comprises a plurality of scallops;

adhering the lower half portion of the breast support structure to the lower part of the first breast;

lifting up the second tab of the upper half portion of the breast support structure over the first breast and adhering the second tab to the upper central part of the first breast to lift the breast up;

lifting up the first tab of the upper half portion of the breast support structure over the first breast and adhering the first tab to the corresponding upper side part of the first breast;

lifting up the third tab of the upper half portion of the breast support structure over the first breast and adhering the third tab to the corresponding upper side part of the first breast; and repeating the above steps for supporting the second breast by a symmetrical second breast support structure.

9. The method according to claim 8, wherein the stretchable medical adhesive tape of the brassiere can support weight from United States sizes 36-38B up to and including 30-32I cup size breast.

10. The method according to claim 8, wherein the stretchable medical adhesive tape of the brassiere can support weight from United Kingdom sizes 36-38B up to and including 30-32G cup size breast.

11. The method according to claim 8, wherein the lower half portion of the breast support structure comprises at least five scallops.

12. The method according to claim 8, wherein the first cut and the second cut are circular in shape.

13. The method according to claim 8, wherein the breasts have sides, and the first tab and the third tab pull the sides of the said breasts inward to create a round shape of the breasts.

* * * * *